US009507282B2

(12) United States Patent
Kihara et al.

(10) Patent No.: US 9,507,282 B2
(45) Date of Patent: Nov. 29, 2016

(54) ELECTROPHOTOGRAPHIC PHOTORECEPTOR AND IMAGE FORMING APPARATUS PROVIDED WITH THE SAME

(71) Applicant: Sharp Kabushiki Kaisha, Osaka-shi, Osaka (JP)

(72) Inventors: Akiko Kihara, Osaka (JP); Kotaro Fukushima, Osaka (JP); Masaki Hashimoto, Osaka (JP); Koichi Toriyama, Osaka (JP); Takahiro Kurauchi, Osaka (JP); Rikiya Matsuo, Osaka (JP); Tomoko Kanazawa, Osaka (JP); Chikako Iibachi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/714,541

(22) Filed: May 18, 2015

(65) Prior Publication Data

US 2015/0346615 A1 Dec. 3, 2015

(30) Foreign Application Priority Data

May 28, 2014 (JP) ..... 2014-110188

(51) Int. Cl.
*G03G 5/05* (2006.01)
*G03G 5/147* (2006.01)
(Continued)

(52) U.S. Cl.
CPC ..... *G03G 5/0539* (2013.01); *G03G 5/047* (2013.01); *G03G 5/051* (2013.01); *G03G 5/0503* (2013.01); *G03G 5/142* (2013.01); *G03G 5/14726* (2013.01)

(58) Field of Classification Search
CPC . G03G 5/0503; G03G 5/0539; G03G 5/14726
(Continued)

(56) References Cited

U.S. PATENT DOCUMENTS 4,663,259 A * 5/1987 Fujimura ..... G03G 5/0539 399/159
4,792,507 A * 12/1988 Yoshihara ..... G03G 5/14791 430/59.6
(Continued)

FOREIGN PATENT DOCUMENTS

JP 01-172970 A 7/1989
JP 3186010 B2 7/2001
(Continued)

OTHER PUBLICATIONS

English language machine translation of JP 2010-230981 (Oct. 2010).*

*Primary Examiner* — Christopher Rodee
(74) *Attorney, Agent, or Firm* — Keating & Bennett, LLP

(57) ABSTRACT

The present invention provides an electrophotographic photoreceptor comprising a multilayered photosensitive layer or a monolayer photosensitive layer, wherein the multilayered photosensitive layer comprises at least a charge generation layer containing a charge generation material and a charge transport layer containing a charge transport material that are stacked on a conductive substrate in this order, and the monolayer photosensitive layer contains a charge generation material and a charge transport material that is stacked on a conductive substrate, wherein the electrophotographic photoreceptor contains 5 to 17 wt % of fluorine resin fine particles and their aggregates with respect to all photoreceptor components in a surface layer of the photoreceptor, wherein the fluorine resin fine particles are 0.1 to 0.5 μm in average primary particle diameter, the aggregates are 1 to 3 μm in constant direction tangent diameter, the number of the aggregates is 10 to 40% of the number of the fluorine resin fine particles.

6 Claims, 3 Drawing Sheets

(51) Int. Cl.
*G03G 5/047* (2006.01)
*G03G 5/14* (2006.01)

(58) Field of Classification Search
USPC ..... 430/58.05, 96
See application file for complete search history.

(56) References Cited

U.S. PATENT DOCUMENTS 4,920,021 A 4/1990 Kimura et al.
5,667,926 A * 9/1997 Maruyama ..... G03G 5/14726 399/343
5,752,140 A 5/1998 Danzuka et al.
6,326,111 B1 * 12/2001 Chambers ..... G03G 5/05 399/176
6,337,166 B1 * 1/2002 Chambers ..... G03G 5/0503 430/132
6,395,441 B1 * 5/2002 Uesugi ..... G03G 5/0564 399/116
7,267,916 B2 * 9/2007 Sugino ..... G03G 5/14726 399/111
7,391,994 B2 * 6/2008 Takada ..... G03G 5/147 399/159
2005/0026058 A1 * 2/2005 Kami ..... G03G 5/047 430/66
2005/0233231 A1 * 10/2005 Qi ..... G03G 5/047 430/58.65
2007/0026236 A1 * 2/2007 Wu ..... G03G 5/051 428/412
2007/0026330 A1 * 2/2007 Wu ..... G03G 5/043 430/58.05
2007/0292794 A1 * 12/2007 Chen ..... G03G 5/047 430/59.6
2011/0236810 A1 * 9/2011 Ishiko ..... G03G 5/14726 430/56
2013/0252152 A1 * 9/2013 Kawabata ..... G03G 5/047 430/56
2015/0160572 A1 * 6/2015 Fukushima ..... G03G 5/0539 430/58.8

FOREIGN PATENT DOCUMENTS

JP 2005-43623 A 2/2005
JP 2005-43765 A 2/2005
JP 2005037562 A * 2/2005
JP 2006-71826 A 3/2006
JP 2009-145480 A 7/2009
JP 2010-230981 A 10/2010
JP 2010230981 A * 10/2010
JP 5110211 B1 12/2012

* cited by examiner

ELECTROPHOTOGRAPHIC PHOTORECEPTOR AND IMAGE FORMING APPARATUS PROVIDED WITH THE SAME

CROSS-REFERENCE TO RELATED APPLICATION

This application is related to Japanese Patent Application No. 2014-110188 filed on May 28, 2014, whose priority is claimed under 35 USC §119, the disclosure of which is incorporated by reference in its entirety.

BACKGROUND OF THE INVENTION

1. Field of the Invention

The present invention relates to an electrophotographic photoreceptor and an image forming apparatus provided the same. More specifically, the present invention relates to the electrophotographic photoreceptor containing in its outermost surface layer fluorine resin fine particles having an average primary particle diameter of 0.1 to 0.5 μm and to the image forming apparatus provided with this photoreceptor.

2. Description of the Related Art

In electrophotographic image forming apparatuses (hereinafter, also referred to as electrophotographic apparatuses) that are used as copying machines, printers, facsimile machines or the like, an image is formed through the following electrophotographic process.

First, a photosensitive layer of an electrophotographic photoreceptor (hereinafter, also referred to as simply "photoreceptor") included in the apparatus is uniformly charged at a predetermined potential by a charger.

Subsequently, the photosensitive layer is exposed to light such as laser light emitted by exposure means according to image information, thereby forming an electrostatic latent image.

A developer is supplied from developing means to the formed electrostatic latent image; and a component of the developer, that is, colored fine particles referred to as a toner adheres to a surface of the photoreceptor so that the electrostatic latent image is developed and visualized as a toner image.

The formed toner image is transferred from the surface of the photoreceptor onto a transfer material such as recording paper by transfer means and is fixed thereon by fixing means.

Not all the toner on the surface of the photoreceptor is, however, transferred onto the recording paper during the transferring process by the transfer means; and some toner is left on the surface of the photoreceptor. In addition, some paper powder of the recording paper having been in contact with the photoreceptor during the transferring process might adhere to the surface of the photoreceptor and remain thereon.

Such foreign matters as the residual toner and the remaining paper powder on the surface of the photoreceptor cause an adverse effect on quality of an image to be formed and thereby are removed by a cleaner.

In recent years, there have been technological advances toward a cleaner-less system, that is, a developing and cleaning system in which the foreign matters such as the residual toner are removed and collected without using independent cleaning means but using a cleaning function added to the developing means.

In this method, the surface of the photoreceptor is cleaned; then electrical charges on a surface of the photosensitive layer are removed by a discharging device to eliminate the remaining electrostatic latent image.

The electrophotographic photoreceptor used in such an electrophotographic process is constructed to comprise the photosensitive layer that contains a photoconductive material and is stacked on a conductive substrate made of a conductive material.

Used for the electrophotographic photoreceptor is an inorganic photoconductive material or an organic photoconductive material (hereinafter, referred to as an organic photoconductor (OPC)). As a result of recent research and development, organic photoreceptors have improved in sensitivity and durability and thus have been used more commonly today.

In terms of the construction of this electrophotographic photoreceptor, multilayered photoreceptors are very much in the mainstream of photoreceptors recently, in which a photosensitive layer comprises the following functionally-separated layers: a charge generation layer containing a charge generation material and a charge transport layer containing a charge transport material. Most of these photoreceptors are negatively chargeable photoreceptors in which a charge transport layer made of a charge transport material having a charge transport ability molecularly dispersed in a binder resin is stacked on a charge generation layer made of a charge generation material vapor-deposited or dispersed in a binder resin.

In addition, monolayer photoreceptors have been proposed, in which a charge generation material and a charge transport material are uniformly dispersed or dissolved in a same binder resin.

Furthermore, in order to improve quality of an image to be printed, an undercoat layer may be provided between the conductive substrate and the photosensitive layer.

A disadvantage of the organic photoreceptor includes surface wear caused by the sliding and brushing of a cleaner or the like on a periphery of the photoreceptor because of the nature of organic materials. In order to overcome this disadvantage, attempts have been made so far to improve mechanical properties of the materials of the surface of the photoreceptor.

There have been known a method such that a protective layer is provided to an outermost surface layer of a photoreceptor so as to give lubricity (see, for example, Japanese Unexamined Patent Publication No. Hei 1(1989)-23259) and a method such that a protective layer contains filler particles (see, for example, Japanese Unexamined Patent Publication No. Hei 1(1989)-172970). In such methods, it has been considered to add fluorine resin fine particles as a filler to the surface (see, for example, Japanese Patent No. 3416310). As one of their characteristics, not only do the fluorine resin fine particles as the filler improve mechanical properties of the photoreceptor, but the fine particles also reduce friction between the photoreceptor and a member coming into contact with the photoreceptor during the process by giving the photoreceptor lubricity owing to a high lubricating function derived from their material; therefore, the fluorine resin fine particles contribute to improvement of printing durability of the surface of the photoreceptor.

Fluorinated fine particles, such as tetrafluoroethylene resin (polytetrafluoroethylene (PTFE)) fine particles, have an excellent lubricating function as a material but are disadvantageous in that these particles have a very large particle-to-particle attraction force and are extremely poor in dispersibility because of a lack of polarity. Accordingly, it is necessary to use a dispersant upon dispersing the tetrafluoroethylene resin fine particles to be used for a photoreceptor (see, for example, Japanese Patent No. 3186010; Japanese Patent No. 5110211; and Japanese Unexamined Patent Publication No. 2009-145480). The dispersant is capable of improving the dispersibility of the tetrafluoroethylene resin fine particles in the photosensitive layer and of preventing deterioration of sensitivity characteristics of the photoreceptor caused by PTFE. The tetrafluoroethylene resin fine particles dispersed uniformly in the photosensitive layer, however, have problems such that the fine particles form trap sites on their surfaces that trap photocarriers having been transferred and that the photoreceptor decreases its sensitivity because of the trapped photocarriers, resulting in a decrease in concentration and image quality.

BRIEF SUMMARY OF THE INVENTION

The tetrafluoroethylene resin fine particles added to the surface layer of the photoreceptor can improve the lubricity of the surface of the photoreceptor and can prevent the photoreceptor from being scratched through long-term use, resulting in improvement in durability.

Although it is desired that the photoreceptor contains a large amount of the tetrafluoroethylene resin fine particles uniformly dispersed in the photosensitive layer to increase the lubricity and the durability of the surface over a long period of time, this photoreceptor has the problem such as a decrease in sensitivity caused by an increase of the exposed surfaces of the tetrafluoroethylene resin fine particles and by an increase of trap sites where trap electrical charges having been transferred in the layer, in particular, electrical charges trapped in a surface of a filler in the layer through repeated use in high temperature and humidity environment; therefore, the present invention has an object of solving the above-described problems.

Namely, the present invention has the object of increasing the lubricity and improving the durability of the surface over a long period of time as well as solving the problem such as the decrease in the sensitivity caused by the trapped charges having been transferred in the surface of the filler through repeated use in the high temperature and humidity environment.

The inventors of the present invention made intensive studies to solve the above-described problems and found as follows: The tetrafluoroethylene resin fine particles contained in the outermost surface layer of the photoreceptor form specific aggregates and reduce exposure of the surfaces of the fine particles, resulting in a decrease of trap sites in the layer and an increase in electric stability through long-term and repeated use. The inventors also completed the present invention by finding as follows: The electrophotographic photoreceptor has the sufficient lubricity on its surface, the printing durability, and the electric stability by adjusting the tetrafluoroethylene resin fine particles in the photosensitive layer in the aggregate state of the present invention.

Accordingly, the present invention provides an electrophotographic photoreceptor comprising a multilayered photosensitive layer or a monolayer photosensitive layer, wherein the multilayered photosensitive layer comprises at least a charge generation layer containing a charge generation material and a charge transport layer containing a charge transport material that are stacked on a conductive substrate in this order, and the monolayer photosensitive layer contains a charge generation material and a charge transport material that is stacked on a conductive substrate, wherein the electrophotographic photoreceptor contains 5 to 17 wt % of fluorine resin fine particles and their aggregates with respect to all photoreceptor components in a surface layer of the photoreceptor, wherein the fluorine resin fine particles are 0.1 to 0.5 μm in average primary particle diameter, the aggregates are 1 to 3 μm in constant direction tangent diameter, the number of the aggregates is 10 to 40% of the number of the fluorine resin fine particles.

The present invention also provides the electrophotographic photoreceptor, wherein the fluorine resin fine particles are 0.2 to 0.4 μm in average primary particle diameter, and the number of the aggregates is 15 to 38% of the number of the fluorine resin fine particles.

The present invention also provides the electrophotographic photoreceptor, wherein the fluorine resin fine particles are tetrafluoroethylene resin fine particles.

The present invention also provides the electrophotographic photoreceptor comprising a multilayered photosensitive layer having an undercoat layer stacked on the conductive substrate.

The present invention also provides the electrophotographic photoreceptor comprising the multilayered photosensitive layer formed of two charge transport layers different in concentration of the charge transport material, wherein a surface layer of the charge transport layers contains the fluorine resin fine particles.

The present invention further provides an image forming apparatus provided with the electrophotographic photoreceptor; charge means for charging the electrophotographic photoreceptor; exposure means for exposing the charged electrophotographic photoreceptor so as to form an electrostatic latent image; developing means for developing the electrostatic latent image with toner to form a toner image; transfer means for transferring the toner image onto a recording material; and fixing means for fixing the transferred toner image on the recording material.

The electrophotographic photoreceptor of the present invention is capable of decreasing the charge trapping in the photosensitive layer by containing the fluorine resin fine particles in the topmost layer of the electrophotographic photoreceptor and forming the aggregates having the specifically ranged constant direction tangent diameter. The present invention, therefore, provides the electrophotographic photoreceptor capable of suppressing a decrease in sensitivity caused by repeated use and of being electrically stable over a long period of time, and the image forming apparatus provided with the photoreceptor.

The present invention also provides the electrophotographic photoreceptor excellent in wear resistance without decreasing the sensitivity even in high temperature and humidity environment over a long period of time.

DETAILED DESCRIPTION OF THE INVENTION

Figure 1:
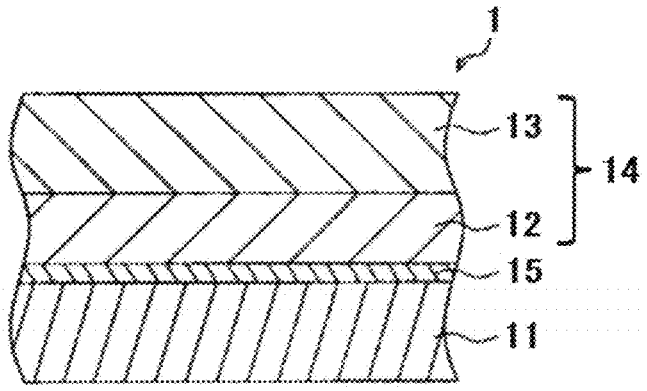
FIG. 1 is a schematic view of a cross-section surface of an electrophotographic photoreceptor according to Embodiment 1 of the present invention.

An electrophotographic photoreceptor of the present invention is characterized by containing 5 to 17 wt % of fluorine resin fine particles and their aggregates with respect to all photoreceptor components in a surface layer of the electrophotographic photoreceptor, wherein the fluorine resin fine particles are 0.1 to 0.5 μm in average primary particle diameter, the aggregates are 1 to 3 μm in constant direction tangent diameter, the number of the aggregates is 10 to 40% of the number of the fluorine resin fine particles.

More specifically, the electrophotographic photoreceptor is characterized by containing tetrafluoroethylene resin (polytetrafluoroethylene (PTFE)) fine particles in the surface layer of the electrophotographic photoreceptor at the above-mentioned ratio.

The electrophotographic photoreceptor (hereinafter, also referred to simply as a "photoreceptor") of the present invention may be a multilayered photoreceptor or a monolayer photosensitive layer, wherein the multilayered photoreceptor has a photosensitive layer comprising a charge generation layer containing a charge generation material and a charge transport layer containing a charge transport material that are stacked on a conductive substrate in this order; and the monolayer photosensitive layer stacked on a conductive substrate is a single photosensitive layer containing a charge generation material and a charge transport material.

The present invention has another feature such that a coating solution for charge transport layer formation may be used as-is to prepare the multilayered photoreceptor and may be used with the addition of the charge generation material to prepare the monolayer photoreceptor.

The multilayered photosensitive layer may be formed of two charge transport layers different in concentration of the charge transport material; and in this case, it is preferred that an outermost surface layer of the charge transport layer contains the tetrafluoroethylene resin fine particles.

Moreover, the monolayer or multilayered photoreceptor may be provided with a protective layer as an outermost surface layer; and in this case, it is preferred that the protective layer contains the tetrafluoroethylene resin fine particles.

The monolayer or multilayered photoreceptor is capable of being electrically stable by using an undercoat layer.

An image forming apparatus (an electrophotographic image forming apparatus) of the present invention is characterized by comprising the electrophotographic photoreceptor; charge means for charging the electrophotographic photoreceptor; exposure means for exposing the charged electrophotographic photoreceptor so as to form an electrostatic latent image; developing means for developing the electrostatic latent image with toner to form a toner image; transfer means for transferring the toner image onto a recording material; and fixing means for fixing the transferred toner image on the recording material and by optionally comprising cleaning means for removing and collecting the residual toner on the electrophotographic photoreceptor and discharging means for removing the remaining electrical charges on the surface of the electrophotographic photoreceptor. The image forming apparatus of the present invention may be configured to comprise the electrophotographic photoreceptor, the charge means, the exposure means, the developing means and the transfer means.

In the following, Embodiments and Examples of the present invention will be explained in detail through the use of FIG. 1 to FIG. 4. Note that the following Embodiments and Examples are simply exemplifications of the present invention and that the present invention should not be limited to these Embodiments and Examples.

Embodiment 1

FIG. 1 is a schematic view of a cross-section surface of an electrophotographic photoreceptor according to the Embodiment of the present invention. An electrophotographic photoreceptor 1 according to the Embodiment of the present invention is a laminated electrophotographic photoreceptor 1 comprising a cylindrical conductive substrate 11 made of a conductive material, an undercoat layer (an intermediate layer) 15 formed on an outer circumferential surface of the conductive substrate 11, and a photosensitive layer 14 formed on an outer circumferential surface of the undercoat layer 15.

As illustrated in FIG. 1, the photosensitive layer 14 comprises a charge generation layer 12 and a charge transport layer 13. The charge generation layer 12 is stacked on the outer circumferential surface of the undercoat layer 15 and contains a charge generation material. The charge transport layer 13 is stacked on an outer circumferential surface of the charge generation layer 12 and contains a charge transport material.

In FIG. 1, the charge transport layer 13 that is one of the two layers constituting the photosensitive layer 14 functions as a surface layer of the photoreceptor 1.

Conductive Substrate 11

The conductive substrate 11 functions as an electrode of the photoreceptor 1 and also as a support of the layers (i.e., the undercoat layer 15 and the photosensitive layer 14) placed at the outer side of the conductive substrate.

The conductive substrate 11 is shaped like a cylinder in the Embodiment of the present invention; however, its shape is not limited to the cylinder and may be shaped like a column, a sheet, or an endless belt.

Usable as the conductive material contained in the conductive substrate 11 is, for example, a conductive metal such as aluminum, copper, brass, zinc, nickel, stainless steel, chromium, molybdenum, vanadium, indium, titanium, gold or platinum; an alloy such as an aluminum alloy; or a metal oxide such as tin oxide or indium oxide.

Note that the conductive material is not limited to these metallic materials; and the following example may be used as the conductive material: a high-polymer material such as polyethylene terephthalate, nylon, polyester, polyoxymethylene or polystyrene; hard paper; or glass, all of which are laminated with a foil of the above-mentioned metallic materials; are vapor-deposited with the above-mentioned metallic material; or are vapor-deposited or coated with a layer of a conductive compound such as a conductive polymer, tin oxide or indium oxide.

These conductive materials are used after being processed into a prescribed shape.

A surface of the conductive substrate 11 may be subjected to, as needed and within the bounds of not affecting image quality, an anodic oxide coating treatment; a surface treatment by use of a chemical, hot water, etc.; a staining treatment; or a diffuse treatment to roughen the surface of the conductive substrate.

In an electrophotographic process using a laser as an exposure light source, wavelengths of laser light are uniform; therefore, laser light reflected from the surface of the photoreceptor interferes with laser light reflected inside the photoreceptor, with the result that an interference pattern caused by this interference could appear on an image and become an image defect.

This image defect caused by the interference of the laser lights uniform in wavelength may be prevented by subjecting the surface of the conductive substrate 11 to the above-mentioned treatment.

Undercoat Layer 15 (Also Referred to as an Interlayer)

Without the undercoat layer 15 between the conductive substrate 11 and the photosensitive layer 14, a defect in the conductive substrate 11 or the photosensitive layer 14 may reduce the chargeability in micro areas, and thus image fogging such as black dots may be generated, leading to a significant image defect. With the undercoat layer 15, it is possible to prevent charge injection from the conductive substrate 11 to the photosensitive layer 14.

With the undercoat layer 15, therefore, reduction in the chargeability of the photosensitive layer 14 can be prevented, and reduction in surface charges in areas other than those where surface charges should be eliminated by light exposure can be suppressed, preventing generation of a defect such as image fogging.

With the undercoat layer 15, furthermore, unevenness in the surface of the conductive substrate 11 can be covered to give an even surface.

Accordingly, the film formation for the photosensitive layer 14 is facilitated, separation of the photosensitive layer 14 from the conductive substrate 11 can be inhibited, and the adhesion between the conductive substrate 11 and the photosensitive layer 14 can be improved.

A resin layer of a variety of resin materials or an alumite layer may be used for the undercoat layer 15.

Examples of the resin materials forming the resin layer as the undercoat layer 15 include resins such as polyethylene resins, polypropylene resins, polystyrene resins, acrylic resins, vinyl chloride resins, vinyl acetate resins, polyurethane resins, epoxy resins, polyester resins, melamine resins, silicone resins, polyvinyl butyral resins, polyvinyl pyrrolidone resins, polyacrylamide resins and polyamide resins; and copolymer resins including two or more of repeat units that form the above-mentioned resins.

Examples of the resin materials also include casein, gelatin, polyvinyl alcohol, cellulose, nitrocellulose and ethylcellulose.

Of these resins, the polyamide resins are preferable; and alcohol-soluble nylon resins are particularly preferable.

Examples of the preferable alcohol-soluble nylon resins include so-called nylons such as 6-nylon, 6,6-nylon, 6,10-nylon, 11-nylon, 2-nylon and 12-nylon; and resins obtained by chemically modifying nylons such as N-alkoxymethyl-modified nylon and N-alkoxyethyl-modified nylon.

To give the undercoat layer a charge controlling function, metal oxide fine particles are added as a filler. The filler may be, for example, particles of titanium oxide, aluminum oxide, aluminum hydroxide or tin oxide. Suitable particle diameters of the metal oxide are of the order of 0.01 to 0.3 μm and preferably of the order of 0.02 to 0.1 μm.

The undercoat layer 15 is formed, for example, by dissolving or dispersing the above-mentioned resin in an appropriate solvent to prepare a coating solution for interlayer formation and by applying this coating solution to the surface of the conductive substrate 11.

The undercoat layer 15 may contain particles such as the above-described metal oxide fine particles in such a way that the metal oxide fine particles such as titanium oxide are dispersed in the resin solution, which is obtained by dissolving the resin in the appropriate solvent, to prepare a coating solution for undercoat layer formation; and this coating solution is applied to the surface of the conductive substrate 11 to form the undercoat layer 15.

Used as the solvent for preparing the coating solution for undercoat layer formation is water or any of organic solvents, or a mixed solvent thereof. For example, used as the solvent is independently used water or alcohol such as methanol, ethanol or butanol. Examples of the mixed solvent include water and alcohol; two or more kinds of alcohols; acetone or dioxolan, and alcohol; and a halogen-based organic solvent such as dichloroethane, chloroform or trichloroethane and alcohol.

Of these solvents, non-halogen organic solvents are preferably used with consideration for global environment.

The metal oxide fine particles may be dispersed in the resin solution by any common dispersion method with the use of a ball mill, a sand mill, an attritor, an oscillation mill, an ultrasonic disperser, a paint shaker or the like.

It is possible to prepare a more stable coating solution by using a media-less disperser that uses a very strong shear force generated by passing the above-described fluid dispersion through micro voids under ultrahigh pressure.

Examples of how the coating solution for undercoat layer formation is applied include a spraying method, a bar coating method, a roll coating method, a blade method, a ring method and a dipping coating method.

Of the coating methods, the dipping coating method in particular is relatively simple and advantageous in terms of productivity and costs and is, therefore, often used for the production of electrophotographic photoreceptors. In the dipping coating method, a substrate is dipped in a coating solution in a coating vessel and then is pulled out of the coating solution at a constant rate or at a rate that successively changes so as to form a layer on a surface of the substrate. An apparatus to be used for the dipping coating method may be provided with a coating solution dispersing machine typified by ultrasonic generators in order to stabilize dispersibility of the coating solution.

The undercoat layer 15 is preferably 0.01 to 20 μm in thickness and more preferably 0.05 to 10 μm.

The undercoat layer 15 having a thickness of less than 0.01 μm is incapable of covering the uneven surface of the conductive substrate 11 to make it even and is incapable of functioning substantially as the undercoat layer 15, with the result that this undercoat layer 15 is not preferable because this layer is incapable of preventing charge injection from the conductive substrate 11 to the photosensitive layer 14 and decreases chargeability of the photosensitive layer 14.

It is difficult to form the undercoat layer 15 having a thickness of more than 20 μm by the dipping coating method and to form the photosensitive layer 14 evenly on the undercoat layer 15, with the result that this undercoat layer 15 is not preferable because this layer decreases sensitivity of the photoreceptor.

It is, therefore, preferable that the undercoat layer 15 is 0.01 to 20 μm in thickness.

Charge Generation Layer 12

The charge generation layer 12 contains, as a main component, a charge generation material that absorbs light to generate electrical charges.

Examples of the charge generation material include organic photoconductive materials containing organic pigments and inorganic photoconductive materials containing inorganic pigments.

Examples of the organic photoconductive materials include azo pigments such as monoazo pigments, bisazo pigments and trisazo pigments; indigoid pigments such as indigo and thioindigo; perylene pigments such as perylenimide and perylenic anhydride; polycyclic quinone pigments such as anthraquinone and pyrenequinone; phthalocyanine pigments such as metal phthalocyanines and metal-free phthalocyanines; squarylium dyes; pyrylium and thiopyrylium salts; and triphenylmethane dyes.

Examples of the inorganic photoconductive materials include selenium and alloys thereof, arsenic-selenium, cadmium sulfide, zinc oxide, amorphous silicon, and other inorganic photoconductors.

The charge generation material may be used in combination with a sensitizing dye. Examples of the sensitizing dye include triphenylmethane-type dyes such as Methyl Violet, Crystal Violet, Night Blue and Victoria Blue; acridine dyes such as Erythrocin, Rhodamine B, Rhodamine 3R, Acridine Orange and Flapeocine; thiazine dyes such as Methylene Blue and Methylene Green; oxazine dyes such as Capri Blue and Meldola's Blue; cyanine dyes; styryl dyes; pyrylium salt dyes; and thiopyrylium salt dyes.

Examples of how the charge generation layer 12 is formed include a method by vacuum deposition of the charge generation material on the surface of the conductive substrate 11 and a method by applying to the surface of the conductive substrate 11 a coating solution for charge generation layer formation obtained by dispersing the charge generation material in an appropriate solvent.

Of the two methods, the latter is preferable such that the coating solution for charge generation layer formation is prepared by dispersing the charge generation material in a binder resin solution by a conventionally known method, the binder resin solution being obtained by mixing a binder resin as a binding agent in a solvent, and the obtained coating solution is applied to the surface of the conductive substrate 11. In the following, this method will be explained.

Examples of the binder resin to be used for the charge generation layer 12 include resins such as polyester resins, polystyrene resins, polyurethane resins, phenol resins, alkyd resins, melamine resins, epoxy resins, silicone resins, acrylic resins, methacrylic resins, polycarbonate resins, polyarylate resins, phenoxy resins, polyvinyl butyral resins, polyvinyl chloride resins and polyvinyl formal resins; and copolymer resins including two or more of repeat units that form the above-mentioned resins.

Specific examples of the copolymer resins include insulating resins such as vinyl chloride-vinyl acetate copolymer resins, vinyl chloride-vinyl acetate-maleic anhydride copolymer resins and acrylonitrile-styrene copolymer resins.

Note that the binder resin is not limited to the above-mentioned resins, and any commonly used resin may be used as the binder resin. These resins may be used independently, or two or more kinds may be used in combination.

Used as the solvent to obtain the coating solution for charge generation layer formation is, for example, a halogenated hydrocarbon such as dichloromethane or dichloroethane; alcohol such as methanol or ethanol; a ketone such as acetone, methyl ethyl ketone or cyclohexanone; an ester such as ethyl acetate or butyl acetate; an ether such as tetrahydrofuran or dioxane; an alkyl ether of ethylene glycol such as 1,2-dimethoxyethane; an aromatic hydrocarbon such as benzene, toluene or xylene; or an aprotic polar solvent such as N,N-dimethylformamide or N,N-dimethylacetamide.

Of these solvents, non-halogen organic solvents are preferably used with consideration for global environment. The above-mentioned solvents may be used independently, or two or more kinds may be used in combination.

As for a ratio between the charge generation material and the binder resin contained in the charge generation layer 12, it is preferred that the ratio W1/W2 between a weight W1 of the charge generation material and a weight W2 of the binder resin is 10/100 to 400/100.

If the ratio W1/W2 is lower than 10/100, the sensitivity of the photoreceptor 1 is easy to decrease.

If the ratio W1/W2 is higher than 400/100, on the other hand, not only is film strength of the charge generation layer 12 decreasing, but dispersibility of the charge generation material also decreases, resulting in an increase of coarse particles. As a result, electrical charges decrease in areas other than those where surface charges should be eliminated by light exposure; and an image defect increases, particularly image fogging called a black dot formed as a small black spot made of a toner on a white background area.

It is, therefore, preferable that the ratio W1/W2 ranges from 10/100 to 400/100.

The charge generation material may be milled with a milling machine before being dispersed in the binder resin solution.

Examples of the milling machine to be used for the milling treatment include a ball mill, a sand mill, an attritor, an oscillation mill and an ultrasonic dispersing machine.

Examples of the dispersing machine to be used for dispersing the charge generation material in the binder resin solution include a paint shaker, a ball mill and a sand mill. Dispersion conditions are set as appropriate so as to prevent impurities from getting into the solution that are generated by abrasion or the like of a container and a member constituting the dispersing machine.

Examples of how the coating solution for charge generation layer formation is applied include a spraying method, a bar coating method, a roll coating method, a blade method, a ring method and a dipping coating method. Of these coating methods, an optimal method may be selected in consideration of physical properties of the coating solution and productivity.

The dipping coating method, in particular, among these coating methods is relatively simple and advantageous in terms of productivity and costs and is, therefore, often used for the production of photoreceptors. In the dipping coating method, a substrate is dipped in a coating solution in a coating vessel and then is pulled out of the coating solution at a constant rate or at a rate that successively changes so as to form a layer on a surface of the substrate.

An apparatus to be used for the dipping coating method may be provided with a coating solution dispersing machine typified by ultrasonic generators in order to stabilize dispersibility of the coating solution.

The charge generation layer 12 is preferably 0.05 to 5 μm in thickness and more preferably 0.1 to 1 μm.

The charge generation layer 12 having a thickness of less than 0.05 μm decreases efficiency of charge generation by light absorption and also decreases sensitivity of the photoreceptor 1.

If the charge generation layer 12 is higher than 5 μm in thickness, on the other hand, not only is light absorption efficiency decreasing, but sensitivity of the photoreceptor 1 also decreases because charge transfer occurs within the charge generation layer 12 to be a rate-determining step in a process of eliminating surface charges of the photosensitive layer 14.

It is, therefore, preferable that the thickness of the charge generation layer 12 ranges from 0.05 to 5 μm.

Charge Transport Layer 13

The charge generation layer 12 is provided with the charge transport layer 13 at its outer circumferential surface. The charge transport layer 13 contains a charge transport material and a binder resin that binds the charge transport material, the charge transport layer having abilities to receive and transport electrical charges generated by the charge generation material contained in the charge generation layer 12.

For the purpose of improving wear resistance and the like of the charge transport layer 13, filler particles may be added.

To the charge transport layer 13, various additives may be added such as an antioxidant, a sensitizer, and a plasticizer or a leveling agent as needed.

The charge transport layer 13 may also have various additives as needed. To improve film formation ability, flexibility or surface smoothness of the charge transport layer 13, the plasticizer or the leveling agent may be added. Examples of the plasticizer include dibasic acid esters such as phthalate esters; fatty acid esters; phosphoric esters; chlorinated paraffins; and epoxy-type plasticizers. Examples of the leveling agent include silicone-based leveling agents.

Examples of the charge transport material include enamine derivatives, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives and benzidine derivatives.

Suitably selected as the binder resin to be contained in the charge transport layer 13 is a polycarbonate resin since this resin is excellent in transparency and printing durability, the polycarbonate resin containing a polycarbonate commonly known in the art as a main component of the polycarbonate resin.

The charge transport layer may also contain another binder resin as a second component in addition to the polycarbonate resin. Used as the second component is, for example, a vinyl polymer resin such as a polymethyl methacrylate resin, a polystyrene resin or a polyvinyl chloride resin; a copolymer resin including two or more of repeat units that form the above-mentioned resins; or a copolymer resin such as a polyester resin, a polyester carbonate resin, a polysulfone resin, a phenoxy resin, an epoxy resin, a silicone resin, a polyarylate resin, a polyamide resin, a polyether resin, a polyurethane resin, a polyacrylamide resin or a phenolic resin, or having a polycarbonate skeleton and a polydimethylsiloxane skeleton.

Used as the second component may be a thermosetting resin that is obtained by partially cross-linking the above-mentioned resins.

These resins may be used independently, or two or more kinds may be used in combination.

The term "main component" means that percentage by weight of the polycarbonate resin accounts for the greatest proportion, desirably 50 to 90 wt %, of the binder resins as a whole contained in the charge transport layer.

The term "second component" means that a content of the binder resin as the second component is lower than a content of the polycarbonate resin and that the second component is used in a range from 10 to 50 wt % with respect to a total weight of the binder resins contained in the charge transport layer 13.

It is preferred that a weight ratio between the charge transport material and the binder resin in the charge transport layer ranges from 10/18 to 10/10.

In the case where the charge transport layer 13 is an outermost layer of the photoreceptor, filler particles may be added for the purpose of improving the wear resistance and the like of the charge transport layer.

The filler particles are roughly classified into organic filler particles and inorganic filler particles including a metal oxide as a central role.

From the viewpoint of mechanical properties for improving the wear resistance of the charge transport layer 13, use of a metal oxide having relatively high hardness as the filler particles is often advantageous.

The filler particles to be added to the charge transport layer 13, however, need to meet the requirements described below; for example, the filler particles should not deteriorate electric properties of the charge transport layer 13.

That is, use of the filler particles having a significantly larger relative dielectric constant (for example, $\in r>10$) in the charge transport layer 13 than an average relative dielectric constant $\in r\approx 3$ of the organic photoreceptor may result in a non-uniform dielectric constant throughout the charge transport layer 13 and may have a negative effect on the electric properties of the charge transport layer.

Accordingly, the filler particles having a relatively small relative dielectric constant may be used more suitably for the charge transport layer without having a negative effect on the electric properties of the charge transport layer.

As the filler particles to be added to the charge transport layer 13, therefore, the organic filler particles are more advantageous than the metal oxides that are generally high in relative dielectric constant.

In the case where the outermost layer of the photoreceptor is aimed at having lubricity, fluorinated fine particles (fluorine resin fine particles) are excellent in lubricity.

The present invention is characterized by using tetrafluoroethylene resin (polytetrafluoroethylene (PTFE)) fine particles as the fluorine resin fine particles, which are the filler particles to be added to the charge transport layer 13.

To add the tetrafluoroethylene resin fine particles to the charge transport layer, it is preferred to use the tetrafluoroethylene resin fine particles having a small diameter so as to decrease light scattering and negative effects on electric carriers in the charge transport layer 13 as much as possible.

In the present invention, therefore, the PTFE fine particles having a primary particle diameter of 0.1 to 0.5 μm are suitably used; and a particle diameter of 0.2 to 0.4 μm is more preferable.

If the tetrafluoroethylene resin fine particles have an average primary particle diameter of less than 0.1 μm, the primary particles are significantly aggregated to increase light scattering.

The PTFE fine particles having a primary particle diameter of more than 0.5 μm cause the light scattering by the primary particles to increase.

It was, therefore, ascertained that the suitable range of the primary particle diameter of the PTFE fine particles is 0.1 to 0.5 μm.

In the present invention, it was ascertained that the charge transport layer containing the charge transport material, the binder resin and the tetrafluoroethylene resin fine particles is preferred to contain the aggregates whose number is 10 to 40% of the total number of the fluorine resin fine particles, provided that the tetrafluoroethylene resin fine particles are 0.1 to 0.5 μm in average primary particle diameter and that the aggregates are 1 to 3 μm in constant direction tangent diameter.

Content percentage (%) of the number of the aggregates in the outermost surface layer of the photoreceptor in a depth direction (a thickness direction) according to the Embodiment of the present invention may be measured with respect to the number of the fluorine resin fine particles, for example, by the following method. A cross-section surface of a photosensitive layer of a photoreceptor is obtained by use of an ion milling (E-3500); and then a measurement sample is obtained from a segment prepared from the cross-section surface; the cross-section surface in a thickness direction of the surface layer of the measurement sample is subjected to uncoated observation at an accelerating voltage of 1 keV using a scanning electron microscope (S-4800 manufactured by Hitachi, Ltd.); and the total number of fluorine resin fine particles and the number of aggregates having a constant direction tangent diameter of 1 to 3 μm are obtained from an electron micrograph of the entire outermost surface layer so as to calculate percentage (%) of the aggregates with respect to the fluorine resin fine particles.

The present invention indicates that the number of the aggregates having the constant direction tangent diameter of 1 to 3 μm is preferably 10 to 40% of the number of the fluorine resin fine particles and more preferably 5 to 38%.

The charge transport layer containing preferably 5 to 17 wt % of the tetrafluoroethylene resin fine particles, more preferably 8 to 12 wt %, with respect to all the solid components of the charge transport layer is capable of providing a photoreceptor excellent in printing durability and stable in electric properties.

The charge transport layer containing the tetrafluoroethylene resin fine particles in concentrations of less than 1 wt % does not bring about effects of improving the wear resistance of the photoreceptor, which are obtained by the addition of the tetrafluoroethylene resin fine particles.

On the other hand, the charge transport layer containing the tetrafluoroethylene resin fine particles in concentrations of more than 30 wt % greatly deteriorates electric properties of the photoreceptor; and the photoreceptor becomes unusable in an image forming apparatus.

The tetrafluoroethylene resin fine particles as the filler particles may be dispersed, in the same manner as the metal oxide fine particles added to the undercoat layer, by any common dispersion method such as that with the use of a ball mill, a sand mill, an attritor, an oscillation mill, an ultrasonic disperser, or a paint shaker. In addition, it is possible to prepare a more stable coating solution by using a media-less disperser that uses a very strong shear force generated by passing a fluid dispersion through micro voids under ultrahigh pressure.

As in the case of the formation of the charge generation layer 12 by the coating method, the charge transport layer 13 is formed by dissolving or dispersing the charge transport material, the binder resin and the filler particles with using the additives as needed in an appropriate solvent to prepare a coating solution for charge transport layer formation and by applying the resulting coating solution to the outer circumferential surface of the charge generation layer 12.

Examples of the solvent of the coating solution for charge transport layer formation include aromatic hydrocarbons such as benzene, toluene, xylene and monochlorobenzene; halogenated hydrocarbons such as dichloromethane and dichloroethane; ethers such as tetrahydrofuran, dioxane and dimethoxymethyl ether; and aprotic polar solvents such as N,N-dimethylformamide. These solvents may be used independently, or two or more kinds may be used in combination.

In addition to the above-mentioned solvent, a solvent such as alcohol, acetonitrile or methyl ethyl ketone may also be used. Of these solvents, non-halogen organic solvents are preferably used with consideration for global environment.

Examples of the method of applying the coating solution for charge transport layer formation include a spraying method, a bar coating method, a roll coating method, a blade method, a ring method and a dipping coating method. Of these coating methods, the dipping coating method in particular is often used for the formation of the charge transport layer 13 because this method is advantageous in various aspects as described above.

The charge transport layer 13 is preferably 5 to 40 μm in thickness and more preferably 10 to 30 μm.

The charge transport layer 13 having a thickness of less than 5 μm is not preferable because this layer decreases its charge retention ability.

The charge transport layer 13 having a thickness of more than 40 μm is not preferable because this layer decreases resolution of the photoreceptor 1.

It was, therefore, ascertained that the suitable range of the thickness of the charge transport layer 13 is 5 to 40 μm.

Additives to be Added to the Photosensitive Layer 14

To improve sensitivity and inhibit an increase in residual potential and fatigue caused by repeated use, one or more kinds of sensitizers such as electron acceptor substances and dyes may be added to each layer (the charge generation layer 12 or the charge transport layer 13) of the photosensitive layer 14.

Used as the electron acceptor substances are, for example, electron attractive materials such as acid anhydrides including succinic anhydride, maleic anhydride, phthalic anhydride and 4-chloronaphthalic acid anhydride; cyano compounds including tetracyanoethylene and terephthalmalondinitrile; aldehydes including 4-nitrobenzaldehyde; anthraquinones including anthraquinone and 1-nitroanthraquinone; polycyclic or heterocyclic nitro compounds including 2,4,7-trinitrofluorenone and 2,4,5,7-tetranitrofluorenone; or diphenoquinone compounds. In addition, these electron attractive materials may be used after being polymerized.

Used as the dyes are, for example, xanthene-based dyes, thiazine dyes, triphenylmethane dyes, quinoline-based pigments or organic photoconductive compounds such as copper phthalocyanine. These organic photoconductive compounds function as an optical sensitizer.

Furthermore, an antioxidant, an ultraviolet absorber or the like may be added to each of the layers constituting the photosensitive layer 14. It is preferable that the antioxidant, the ultraviolet absorber or the like is added particularly to the charge transport layer 13; and the addition of the antioxidant, the ultraviolet absorber or the like to the charge transport layer enhances stability of the coating solution for forming each layer.

The addition of the antioxidant to the charge transport layer 13 enables the photosensitive layer to decrease its deterioration caused by an oxidized gas such as ozone or a nitrogen oxide. Examples of the antioxidant include phenol compounds, hydroquinone compounds, tocopherol compounds and amine compounds. Of these antioxidants, hindered phenol derivatives or hindered amine derivatives, or mixtures thereof are suitably used.

Embodiment 2

Embodiment 1 has described that the photosensitive layer 14 is a multilayered photosensitive layer comprising the charge generation layer 12 and the charge transport layer 13. In another Embodiment illustrated in FIG. 2, however, the photosensitive layer 14 may be a single layer—that is, a monolayer photosensitive layer—containing both a charge generation material and a charge transport material.

More specifically, the photoreceptor 1 may comprise the cylindrical conductive substrate 11 made of a conductive material and the photosensitive layer 14 that is stacked on the outer circumferential surface of the conductive substrate 11 and contains the charge generation material and the charge transport material. In this Embodiment, the charge generation material may be added and dispersed in the coating solution for charge transport layer formation of the present invention to make this solution a coating solution for monolayer photosensitive layer formation.

Figure 2:
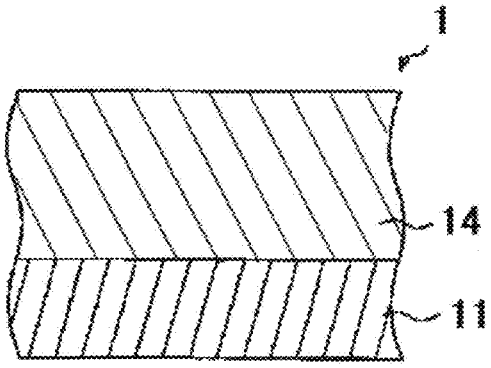
FIG. 2 is a schematic view of a cross-section surface of an electrophotographic photoreceptor according to Embodiment 2 of the present invention.

In the structure illustrated in FIG. 2, the entire photosensitive layer 14 is a surface layer of the photoreceptor 1; and the PTFE fine particles are added to the photosensitive layer 14.

Embodiment 3

Figure 3:
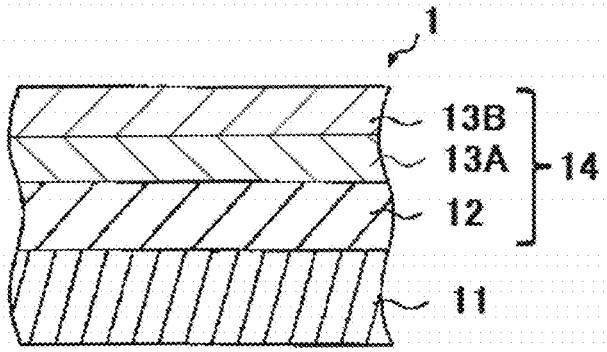
FIG. 3 is a schematic view of a cross-section surface of an electrophotographic photoreceptor according to Embodiment 3 of the present invention.

As illustrated in FIG. 3, a charge transport layer may be formed of a plurality of layers. In FIG. 3, the photoreceptor 1 comprises the conductive substrate 11 and the photosensitive layer 14 formed on an outer circumferential surface of the conductive substrate 11. The photosensitive layer 14 comprises the charge generation layer 12 formed on the outer circumferential surface of the conductive substrate 11, a first charge transport layer 13A formed on an outer circumferential surface of the charge generation layer 12, and a second charge transport layer 13B formed on an outer circumferential surface of the first charge transport layer 13A. The photoreceptor 1 of FIG. 3 is configured in such a way that a content of the charge transport material in the first charge transport layer 13A is different from a content of the charge transport material in the second charge transport layer 13B. In the structure illustrated in FIG. 3, the second charge transport layer 13B is an outermost surface layer among all the layers constituting the photosensitive layer 14; and the above-described tetrafluoroethylene resin fine particles are added to the second charge transport layer 13B.

The present invention may have another aspect such that the photosensitive layer is provided with a protective layer on its outer circumferential surface, and the protective layer functions as a surface layer. In this aspect, the tetrafluoroethylene resin fine particles are added to a binder resin in the protective layer.

Embodiment 4

Image Forming Apparatus

In the following, an electrophotographic image forming apparatus provided with the photoreceptor of the present invention will be explained.

Figure 4:
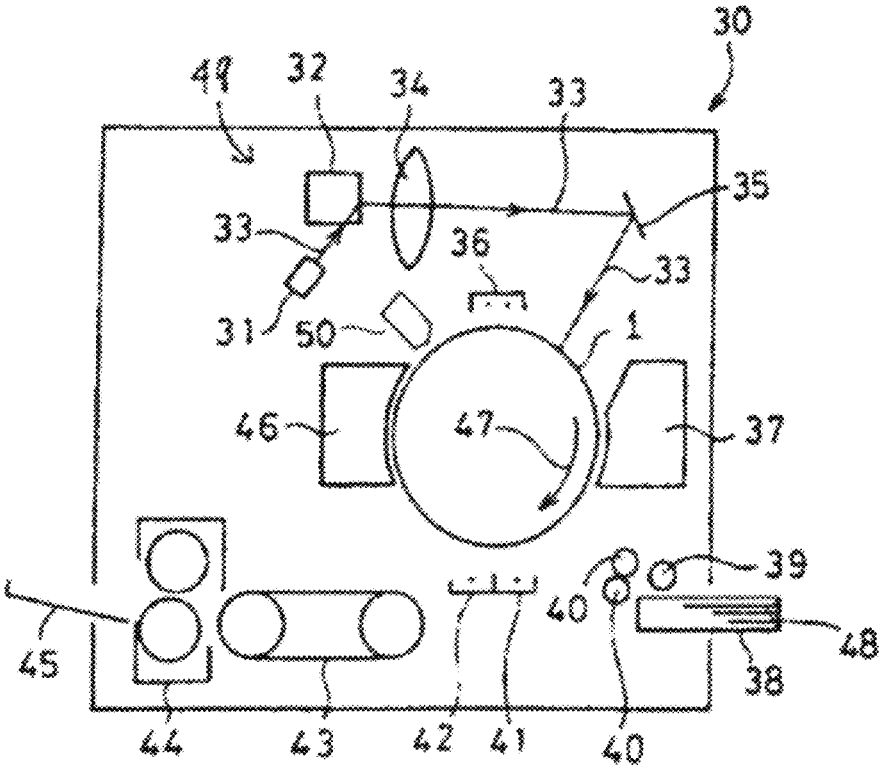
FIG. 4 is a schematic side view of a cross-section surface of an image forming apparatus according to Embodiment 4 of the present invention.
Figure 5:
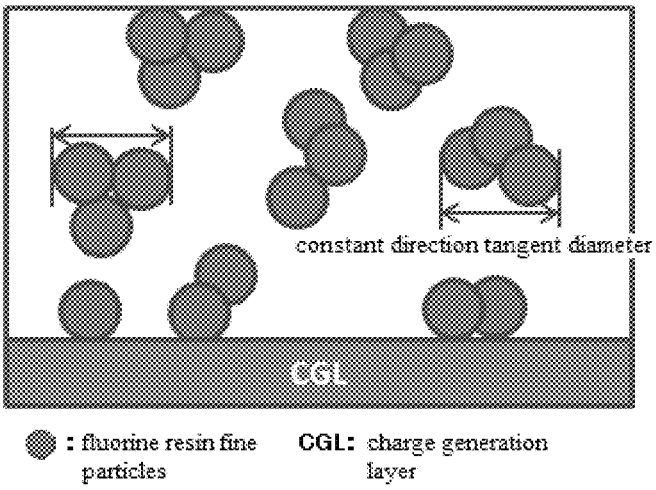
FIG. 5 is a schematic view of a dispersed state of tetrafluoroethylene resin fine particles and their aggregates in a surface layer of an electrophotographic photoreceptor of the present invention.

FIG. 4 is a schematic cross-section view of the inside of an image forming apparatus 30 according to the Embodiment of the present invention.

The image forming apparatus 30 is a laser printer. The image forming apparatus 30 is provided with a photoreceptor 1, a semiconductor laser 31, a rotary polygon mirror 32, an imaging lens 34, a mirror 35, a corona charger 36, a developing device 37, a sheet feed cassette 38, a sheet feed roller 39, registration rollers 40, a transfer charger 41, a separation charger 42, a conveyance belt 43, a fixing device 44, a sheet receiving tray 45 and a cleaner 46.

The photoreceptor 1 is mounted in the image forming apparatus 30 in such a manner that it can be rotated in a direction of an arrow 47 by driving means, not shown. A laser beam 33 emitted from the semiconductor laser 31 is scanned by the rotary polygon mirror 32. The imaging lens 34 has an f-θ characteristic, and causes the laser beam 33 to be reflected on the mirror 35 to form an image on the surface of the photoreceptor 1. The laser beam 33 is scanned and imaged as described above while the photoreceptor 1 is rotated, thereby forming an electrostatic latent image according to image information on the surface of the photoreceptor 1.

The corona charger 36, the developing device 37, the transfer charger 41, the separation charger 42 and the cleaner 46 are disposed in this order from the upstream side to the downstream side of a rotation direction of the photoreceptor 1 as indicated by the arrow 47. The corona charger 36 is disposed on the upstream side of the rotation direction of the photoreceptor 1 from an imaging point of the laser beam 33 to uniformly charge the surface of the photoreceptor 1. The uniformly charged surface of the photoreceptor 1 is irradiated with (exposed to) the laser beam 33, bringing about a difference in charge amount between an area exposed to the laser beam and an area not exposed to the laser beam, with the result that the above-mentioned electrostatic latent image is formed.

The developing device 37 is disposed on the downstream side of the rotation direction of the photoreceptor 1 from the imaging point of the laser beam 33 and supplies a toner to the electrostatic latent image formed on the surface of the photoreceptor 1 so as to develop the electrostatic latent image as a toner image. Transfer sheets 48 contained in the transfer sheet cassette 38 are taken out one by one by the sheet feed roller 39 and are provided to the transfer charger 41 by the registration rollers 40. The toner image is transferred onto the transfer sheet 48 by the transfer charger 41. The separation charger 42 removes electrical charges from the transfer sheet, onto which the toner image has been transferred, so that the sheet is separated from the photoreceptor 1.

The transfer sheet 48 separated from the photoreceptor 1 is conveyed to the fixing device 44 by the conveyance belt 43, the toner image is fixed on the transfer sheet by the fixing device 44 to form an image, and then the transfer sheet is ejected onto the sheet receiving tray 45. After the transfer sheet 48 is separated by the separation charger 42, the photoreceptor 1 keeps on rotating so that the cleaner 46 removes the toner and foreign substances such as paper poder left on the surface of the photoreceptor. The electrical charges of the photoreceptor 1 whose surface has been cleaned are removed by a discharger (discharge lamp) 50. As the photoreceptor 1 keeps on rotating, a series of such image formation operations is repeated.

Note that the image forming apparatus 30 is not limited to the structure illustrated in FIG. 4 and may be either a black-and-white printer or a color printer as long as the image forming apparatus is provided with the photoreceptor. The image forming apparatus 30 may be used as one of various types of printers, copying machines, facsimile machines and multifunctional systems that use an electrophotographic process.

EXAMPLES

In the following, the Embodiments of the present invention will be explained in detail in the manner of Examples; however, the Embodiments of the present invention should not be limited to the following explanations.

Example 1

Preparation of an Undercoat Layer 15 (an Interlayer)

3 parts by weight of titanium oxide (trade name: Tipaque TTO-D-1, available from Ishihara Sangyo Kaisha, Ltd.) and 2 parts by weight of a commercial polyamide resin (trade name: Amilan CM8000, available from Toray Industries, Inc.) were mixed with 25 parts by weight of methyl alcohol and dispersed with a paint shaker for 8 hours to obtain 3 kg of a coating solution for undercoat layer formation. (Namely, the coating solution is the mixture that was subjected to the dispersion treatment.) The coating solution was then applied to a conductive support by a dipping coating method. More specifically, a coating vessel was filled with the obtained coating solution; and a drum-like aluminum support, as the conductive support, having a diameter of 30 mm and a length of 357 mm was dipped in the coating solution and then was pulled out of the coating solution to form an undercoat layer (an interlayer) having a thickness of 1 μm.

Preparation of a Charge Generation Layer 12

An oxotitanylphthalocyanine was used as a charge generation material, that indicates maximum diffraction peaks at Bragg angles (2θ±0.2°) of 7.3°, 9.4°, 9.7° and 27.3° relative to an X-ray of CuKα at a wavelength of 1.541 Å; and a butyral resin (trade name: S-LEC BM-2, available from Sekisui Chemical Co., Ltd.) was used as a binder resin. 1 part by weight of the charge generation material and 1 part by weight of the binder resin were mixed with 98 parts by weight of methyl ethyl ketone and were dispersed with a paint shaker for 8 hours to obtain 3 liters of a coating solution for charge generation layer formation. (Namely, the coating solution is the mixture that was subjected to the dispersion treatment.)

The coating solution for charge generation layer formation was applied to a surface of the undercoat layer by a dipping coating method in the same manner as the undercoat layer formation. More specifically, a coating vessel was filled with the obtained coating solution for charge generation layer formation; and the drum-like support coated with the undercoat layer was dipped in the coating solution, pulled out thereof, and air-dried to form a charge generation layer having a thickness of 0.3 μm.

Preparation of a Charge Transport Layer 0.28 parts by weight of GF-400 (available from Toagosei Co., Ltd.) as a particle dispersant was added to 12 parts by weight of polytetrafluoroethylene resin fine particles (Lubron L-2, available from Daikin Industries, Ltd.) having a primary particle diameter of about 0.2 μm; and 55 parts by weight of TS2050 (available from Teijin Chemicals, Ltd.) as a charge transport layer binder resin and 35 parts by weight of compound 1 (T2269, available from Tokyo Chemical Industry Co., Ltd., N,N,N',N'-tetrakis(4-methylphenyl)benzidine) as a charge transport material represented by the following formula (1) were used:

(1)

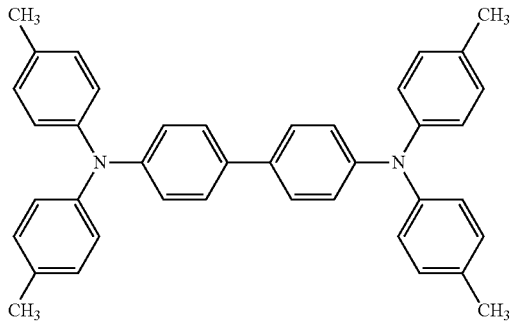

The obtained mixture was then mixed with tetrahydrofuran (384 parts by weight) to form a suspension having a solid content of 21 wt %. Thereafter, the suspension was subjected to a dispersion treatment by passing through a wet type emulsifying and dispersing machine (NVL-AS160, available from Yoshida Kikai Co., Ltd.) five times at a pressure set at 95 MPa so as to form 3 kg of a coating solution for charge transport layer formation. (Namely, the coating solution is the solution that was subjected to the dispersion treatment.)

The coating solution for charge transport layer formation was then applied to a surface of the charge generation layer by a dipping coating method. More specifically, a coating vessel was filled with the obtained coating solution for charge transport layer formation; and the drum-like support coated with the charge generation layer was dipped in the coating solution, pulled out thereof, and dried at 120° C. for 1 hour to form a charge transport layer having a thickness of 28 μm. In this way, a photoreceptor was prepared, that has a structure illustrated in FIG. 1.

Example 2

An undercoat layer and a charge generation layer were prepared in the same manner as in Example 1. Thereafter, a coating solution for charge transport layer formation was prepared in the same manner as in Example 1 except that 8 parts by weight of the tetrafluoroethylene resin fine particles and 0.19 parts by weight of GF-400 (available from Toagosei Co., Ltd.) as a particle dispersant were added so that a photoreceptor was prepared with use of the coating solution.

Example 3

An undercoat layer and a charge generation layer were prepared in the same manner as in Example 1. Thereafter, a coating solution for charge transport layer formation was prepared in the same manner as in Example 1 except that 10 parts by weight of the tetrafluoroethylene resin fine particles and 0.23 parts by weight of GF-400 (available from Toagosei Co., Ltd.) as a particle dispersant were added so that a photoreceptor was prepared with use of the coating solution.

Figure 6:
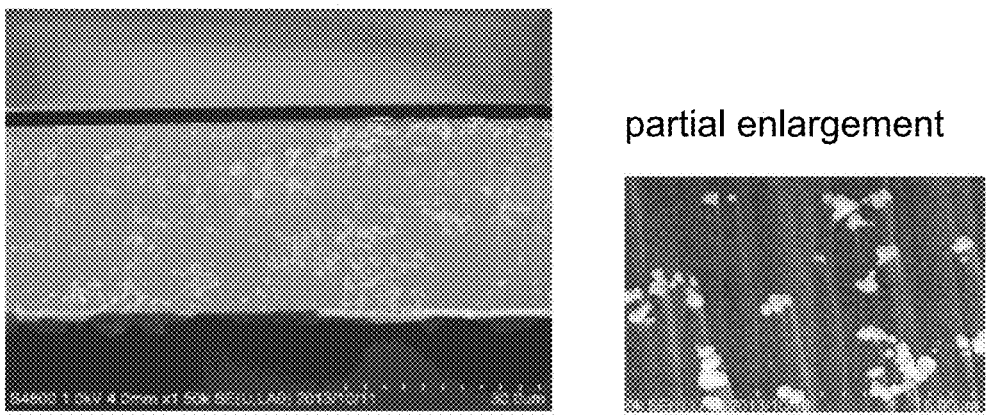
FIG. 6 provides an electron micrograph and its partially enlarged image of a dispersed state of tetrafluoroethylene resin fine particles and their aggregates in a surface layer of an electrophotographic photoreceptor of the present invention.

FIG. 6 provides an electron micrograph and its enlarged image of a dispersed state of the tetrafluoroethylene resin fine particles and their aggregates in the surface layer of the photoreceptor prepared in Example 3.

Example 4

An undercoat layer and a charge generation layer were prepared in the same manner as in Example 1. Thereafter, a coating solution for charge transport layer formation was prepared in the same manner as in Example 3 except that the tetrafluoroethylene resin fine particles were dispersed at a pressure set at 105 MPa by a wet type emulsifying and dispersing machine so that a photoreceptor was prepared with use of the coating solution.

Example 5

An undercoat layer and a charge generation layer were prepared in the same manner as in Example 1. Thereafter, a coating solution for charge transport layer formation was prepared in the same manner as in Example 3 except that the tetrafluoroethylene resin fine particles were dispersed at a pressure set at 90 MPa by a wet type emulsifying and dispersing machine so that a photoreceptor was prepared with use of the coating solution.

Example 6

An undercoat layer and a charge generation layer were prepared in the same manner as in Example 1. Thereafter, a coating solution for charge transport layer formation was prepared in the same manner as in Example 1 except that 6 parts by weight of the tetrafluoroethylene resin fine particles and 0.13 parts by weight of GF-400 (available from Toagosei Co., Ltd.) as a particle dispersant were added so that a photoreceptor was prepared with use of the coating solution.

Example 7

An undercoat layer and a charge generation layer were prepared in the same manner as in Example 1. Thereafter, a coating solution for charge transport layer formation was prepared in the same manner as in Example 3 except that the tetrafluoroethylene resin fine particles were dispersed at a pressure set at 112 MPa by a wet type emulsifying and dispersing machine so that a photoreceptor was prepared with use of the coating solution.

Example 8

An undercoat layer and a charge generation layer were prepared in the same manner as in Example 1. Thereafter, a coating solution for charge transport layer formation was prepared in the same manner as in Example 3 except that the tetrafluoroethylene resin fine particles were dispersed at a pressure set at 88 MPa by a wet type emulsifying and dispersing machine so that a photoreceptor was prepared with use of the coating solution.

Example 9

An undercoat layer and a charge generation layer were prepared in the same manner as in Example 1. Thereafter, a coating solution for charge transport layer formation was prepared in the same manner as in Example 4 except that 15 parts by weight of the tetrafluoroethylene resin fine particles and 0.35 parts by weight of GF-400 (available from Toagosei Co., Ltd.) as a particle dispersant were added so that a photoreceptor was prepared with use of the coating solution.

Example 10

An undercoat layer and a charge generation layer were prepared in the same manner as in Example 1. Thereafter, a coating solution for charge transport layer formation was prepared in the same manner as in Example 3 except that the tetrafluoroethylene resin fine particles were dispersed at a pressure set at 121 MPa by a wet type emulsifying and dispersing machine so that a photoreceptor was prepared with use of the coating solution.

Comparative Example 1

An undercoat layer and a charge generation layer were prepared in the same manner as in Example 1. Thereafter, a coating solution for charge transport layer formation was prepared without using any tetrafluoroethylene resin fine particles and dispersant in the coating solution for charge transport layer formation but with using tetrahydrofuran as a solvent to be mixed and stirred in the coating solution so that a photoreceptor was prepared with use of the coating solution.

Comparative Example 2

An undercoat layer and a charge generation layer were prepared in the same manner as in Example 1. Thereafter, a coating solution for charge transport layer formation was prepared in the same manner as in Example 1 except that 4 parts by weight of the tetrafluoroethylene resin fine particles and 0.1 parts by weight of GF-400 (available from Toagosei Co., Ltd.) as a particle dispersant were added so that a photoreceptor was prepared with use of the coating solution.

Comparative Example 3

An undercoat layer and a charge generation layer were prepared in the same manner as in Example 1. Thereafter, a coating solution for charge transport layer formation was prepared in the same manner as in Example 1 except that the tetrafluoroethylene resin fine particles were dispersed by passing through a wet type emulsifying and dispersing machine six times at a pressure set at 115 MPa so that a photoreceptor was prepared with use of the coating solution.

Figure 7:
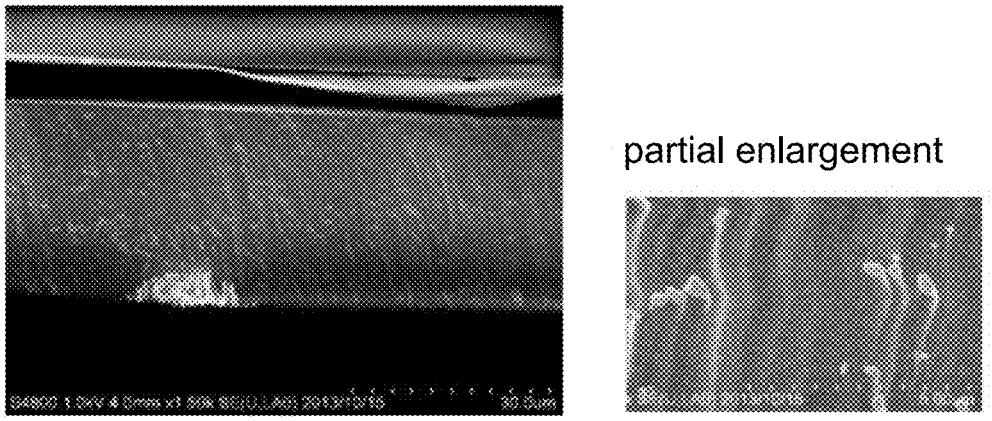
FIG. 7 provides an electron micrograph and its partially enlarged image of a dispersed state of tetrafluoroethylene resin fine particles and their aggregates in a surface layer of an electrophotographic photoreceptor of the present invention.

FIG. 7 provides an electron micrograph and its enlarged image of a dispersed state of the tetrafluoroethylene resin fine particles and their aggregates in the surface layer of the photoreceptor prepared in Comparative Example 3.

Comparative Example 4

An undercoat layer and a charge generation layer were prepared in the same manner as in Example 1. Thereafter, a coating solution for charge transport layer formation was prepared in the same manner as in Example 1 except that the tetrafluoroethylene resin fine particles were dispersed by passing through a wet type emulsifying and dispersing machine six times at a pressure set at 120 MPa so that a photoreceptor was prepared with use of the coating solution.

Comparative Example 5

An undercoat layer and a charge generation layer were prepared in the same manner as in Example 1. Thereafter, a coating solution for charge transport layer formation was prepared in the same manner as in Example 1 except that 18 parts by weight of the tetrafluoroethylene resin fine particles and 0.4 parts by weight of GF-400 (available from Toagosei Co., Ltd.) as a particle dispersant were added, and then the tetrafluoroethylene resin fine particles were dispersed by passing through a wet type emulsifying and dispersing machine six times at a pressure set at 115 MPa so that a photoreceptor was prepared with use of the coating solution.

Comparative Example 6

An undercoat layer and a charge generation layer were prepared in the same manner as in Example 1. Thereafter, a coating solution for charge transport layer formation was prepared in the same manner as in Example 1 except that the tetrafluoroethylene resin fine particles were dispersed at a pressure set at 90 MPa by a wet type emulsifying and dispersing machine so that a photoreceptor was prepared with use of the coating solution.

Comparative Example 7

An undercoat layer and a charge generation layer were prepared in the same manner as in Example 1. Thereafter, a coating solution for charge transport layer formation was prepared in the same manner as in Example 1 except that the tetrafluoroethylene resin fine particles were dispersed at a pressure set at 85 MPa by a wet type emulsifying and dispersing machine so that a photoreceptor was prepared with use of the coating solution.

Comparative Example 8

An undercoat layer and a charge generation layer were prepared in the same manner as in Example 1. Thereafter, a coating solution for charge transport layer formation was prepared in the same manner as in Example 1 except that the tetrafluoroethylene resin fine particles were dispersed at a pressure set at 80 MPa by a wet type emulsifying and dispersing machine so that a photoreceptor was prepared with use of the coating solution.

Comparative Example 9

An undercoat layer and a charge generation layer were prepared in the same manner as in Example 1. Thereafter, a coating solution for charge transport layer formation was prepared in the same manner as in Example 5 except that the tetrafluoroethylene resin fine particles were dispersed at a pressure set at 80 MPa by a wet type emulsifying and dispersing machine so that a photoreceptor was prepared with use of the coating solution.

Table 1 provides the results obtained as follows: The photosensitive layer was separated from the photoreceptor prepared in each of Examples 1 to 10 and Comparative Examples 2 to 9 by the above-described methods; the segment was obtained as a sample from the photosensitive layer; the sample was scanned with a scanning electron microscope (SEM) to obtain a cross-section image of the outermost surface layer of the sample; and the number of the aggregates formed of the tetrafluoroethylene resin fine particles and the number of the tetrafluoroethylene resin fine particles were measured to calculate content percentage (%) of the aggregates. Note that FIG. 6 provides the cross-section images of Example 3; and FIG. 7 provides the cross-section images of Comparative Example 3.

Evaluation of Electric Properties

The photoreceptors of Examples 1 to 10 and Comparative Examples 1 to 9 were evaluated for electric properties (sensitivities) as follows.

With the above-mentioned test copying machine obtained by modifying a digital copying machine (trade name: MX-2600, available from Sharp Corporation), each photoreceptor prepared in Examples 1A to 9A and Comparative Examples 1A to 7A was measured for the surface potential VL in an initial stage (before printing) and after continuous copying of 100,000 sheets under a constant environment at 35° C. (high temperature)/85% (high humidity). The surface potential VL refers to the surface potential of a photoreceptor in the black region during exposure, that is, the surface potential of the photoreceptor in the developing section.

Thereafter, a difference ΔVL was calculated by subtracting the surface potential in the initial stage from the surface potential after the repeated copying of 100,000 sheets in each case of Examples 1 to 10 and Comparative Examples 1 to 9. The evaluation of the electric properties of the photoreceptors was indicated as follows.

VG: very good ($0 \leq \Delta VL < 60$)

G: good ($60 \leq \Delta VL < 95$)

NB: tolerable for practical use ($95 \leq \Delta VL < 140$)

B: not tolerable for practical use ($140 \leq \Delta VL$)

Evaluation of Film Loss of Actual Copying

The photoreceptor obtained in each of Examples 1 to 10 and Comparative Examples 1 to 9 was installed in the test copying machine converted from the digital copying machine (trade name: MX-2600, available from Sharp Corporation). The test copying machine was provided with a surface potentiometer (model 344, available from Trek Japan K.K.) to measure a surface potential of the photoreceptor during the image formation step. The photoreceptor was exposed to laser light having a wavelength of 780 nm emitted from a light source.

An amount of change in film thickness of the drum-like photoreceptor was obtained from a comparison between a film thickness of the photoreceptor before the actual copying of 100,000 sheets and a film thickness of the photoreceptor after the actual copying of 100,000 sheets under a constant environment at 25° C. (normal temperature)/50% (normal humidity), the amount of change being measured with an eddy-current thickness meter (available from Fischer Instruments K.K.), and the obtained amount of change was converted to a film loss amount per 100,000 revolutions of the photoreceptor and was designated as a film loss amount.

The film loss was evaluated on the basis of the film loss amount per 100,000 revolutions.

VG: very good (film loss amount<0.8 μm)

G: good (0.8 μm≤film loss amount<1.0 μm)

NB: not bad (1.0 μm≤film loss amount<2.0 μm)

B: bad (2.0 μm<film loss amount)

Overall Evaluation

The overall evaluation was made as follows in view of the above-mentioned electric properties and the results of the film loss test and of the scratch resistance test.

VG: very good (two categories were evaluated as being VG in the above-described evaluations)

G: good (two categories were evaluated as being G, or one category was evaluated as being G and the other was evaluated as being NB, in the above-described evaluations)

B: not tolerable for practical use (at least one categories was evaluated as being B in the above-described evaluations)

TABLE 1

| | percentage (%) of tetrafluoroethylene resin fine particles with respect to all photoreceptor components | content percentage (%) of the number of aggregates with respect to the number of tetrafluoroethylene resin fine particles | electric properties ΔVL in high temperature and humidity environment | evaluation | film loss amount after actual copying (μm/100K revolutions) | evaluation | overall evaluation |
|---|---|---|---|---|---|---|---|
| Ex 1 | 12% | 36% | 68 V | G | 0.58 | VG | G |
| Ex 2 | 8% | 28% | 50 V | VG | 0.79 | VG | VG |
| Ex 3 | 10% | 30% | 58 V | VG | 0.67 | VG | VG |
| Ex 4 | 10% | 25% | 55 V | VG | 0.68 | VG | VG |
| Ex 5 | 10% | 38% | 42 V | VG | 0.91 | G | G |
| Ex 6 | 6% | 29% | 50 V | VG | 0.95 | G | G |
| Ex 7 | 10% | 21% | 92 V | G | 0.63 | VG | G |
| Ex 8 | 10% | 34% | 44 V | G | 0.79 | VG | G |
| Ex 9 | 15% | 33% | 75 V | G | 0.64 | VG | G |
| Ex 10 | 10% | 18% | 76 V | G | 0.60 | VG | G |
| Comp Ex 1 | — | — | 20 V | VG | 2.86 | B | B |
| Comp Ex 2 | 3% | 21% | 40 V | VG | 2.1 | B | B |
| Comp Ex 3 | 12% | 8% | 145 V | B | 0.56 | VG | B |
| Comp Ex 4 | 12% | 1% | 230 V | B | 0.55 | VG | B |
| Comp Ex 5 | 18% | 22% | 170 V | B | 0.5 | VG | B |
| Comp Ex 6 | 12% | 42% | 60 V | G | 2.13 | B | B |
| Comp Ex 7 | 12% | 55% | 51 V | G | 2.43 | B | B |
| Comp Ex 8 | 12% | 60% | 51 V | G | 2.52 | B | B |
| Comp Ex 9 | 10% | 41% | 59 V | VG | 2.09 | B | B |

It was ascertained from Table 1 that the aggregates formed of the tetrafluoroethylene resin fine particles in the outermost surface layer of each photoreceptor prepared in Examples 1 to 10 have the constant direction tangent diameter within the range specified in the present invention and that a decrease in sensitivity of the photoreceptors of Examples 1 to 10 was suppressed in the high temperature and humidity environment.

Moreover, the photoreceptors of Examples 1 to 10 containing the tetrafluoroethylene resin fine particles had the more excellent results from the film loss test than the photoreceptor of Comparative Example 1 that does not contain the tetrafluoroethylene resin fine particles. It was, therefore, ascertained from these results that the outermost surface layer containing the tetrafluoroethylene resin fine particles certainly increases its durability. In addition, it was ascertained that the photoreceptors of the present invention are capable of stably maintaining the electric properties even in the high temperature and humidity environment and of providing high quality of images over a long period of time.

Although it is desired that the outermost surface layer of the photoreceptor is high in content of the tetrafluoroethylene resin fine particles to increase the durability of the photoreceptor, there is a tendency for the outermost surface layer having the higher content of the tetrafluoroethylene resin fine particles to worsen the sensitivity of the photoreceptor in the high temperature and humidity environment. The reason for this is that the sensitivity of the photoreceptor is affected by an increase of trap sites on the surfaces of the tetrafluoroethylene resin fine particles where trap the electrical charges having been transferred. The present invention, however, seems to be capable of decreasing the trap sites by forming the aggregates of the tetrafluoroethylene resin fine particles in the outermost surface layer with the intention of reducing exposure of the surfaces of the tetrafluoroethylene resin fine particles. It seems that the uniformly dispersed tetrafluoroethylene resin fine particles of Comparative Examples 3 and 4 increase trap sites trapping the electrical charges in the high temperature and humidity environment; therefore, the photoreceptor has the sensitivity significantly lower than that of the photoreceptor of Example 1. In the meanwhile, the large aggregates in the outermost surface layer described in Comparative Examples 6, 7, 8 and 9 seem to have an advantage in increasing the sensitivity of the photoreceptor in the high temperature and humidity environment; however, the large aggregates make the tetrafluoroethylene resin fine particles in the outermost surface layer bind to each other insufficiently, with the result that the photosensitive layer is low in durability, is intolerant to the actual copying test over a long period of time, and is large in film loss.

It was ascertained from Examples 1 to 10 that the photoreceptors having the outermost surface layers higher in content of the tetrafluoroethylene resin fine particles among all the photoreceptor components are capable of decreasing the film loss amount after the actual copying but have a tendency to increase ΔVL in the high temperature and humidity environment.

It was also ascertained regarding the aggregates of the tetrafluoroethylene resin fine particles that larger percentage (%) of the number of the aggregates with respect to the number of the tetrafluoroethylene resin fine particles has a tendency to decrease ΔVL in the high temperature and humidity environment but has a tendency to increase the film loss amount after the actual copying.

Accordingly, the tetrafluoroethylene resin fine particles are preferred to have the content from 5 to 17 wt % with respect to all the photoreceptor components; and it is preferable that the number of the aggregates is 10 to 40% of the number of the tetrafluoroethylene resin fine particles, and more preferably 15 to 38%.

As a result, it was ascertained that each component needs to be in the range specified in the present invention.

INDUSTRIAL APPLICABILITY

The electrophotographic photoreceptor of the present invention is capable of decreasing the charge trapping in the photosensitive layer by containing the tetrafluoroethylene resin fine particles in the topmost layer of the photoreceptor and forming the aggregates having the specifically ranged constant direction tangent diameter. The present invention, therefore, provides the electrophotographic photoreceptor capable of suppressing a decrease in sensitivity caused by repeated use and of being electrically stable over a long period of time, and the image forming apparatus provided with the photoreceptor.

The invention claimed is:

1. An electrophotographic photoreceptor comprising a multilayered photosensitive layer or a monolayer photosensitive layer, wherein the multilayered photosensitive layer comprises at least a charge generation layer containing a charge generation material and a charge transport layer containing a charge transport material that are stacked on a conductive substrate in this order, and the monolayer photosensitive layer contains a charge generation material and a charge transport material that is stacked on a conductive substrate, wherein the electrophotographic photoreceptor contains 5 to 17 wt % of fluorine resin fine particles and their aggregates with respect to all photoreceptor components in a surface layer of the photoreceptor, wherein the fluorine resin fine particles are 0.1 to 0.5 μm in average primary particle diameter, the aggregates are 1 to 3 μm in constant direction tangent diameter, the number of the aggregates is 10 to 40% of the number of the fluorine resin fine particles.

2. The electrophotographic photoreceptor according to claim 1, wherein the fluorine resin fine particles are 0.2 to 0.4 μm in average primary particle diameter, and the number of the aggregates is 15 to 38% of the number of the fluorine resin fine particles.

3. The electrophotographic photoreceptor according to claim 1, wherein the fluorine resin fine particles are tetrafluoroethylene resin fine particles.

4. The electrophotographic photoreceptor according to claim 1 comprising a multilayered photosensitive layer having an undercoat layer stacked on the conductive substrate.

5. The electrophotographic photoreceptor according to claim 1 comprising the multilayered photosensitive layer formed of two charge transport layers different in concentration of the charge transport material, wherein a surface layer of the charge transport layers contains the fluorine resin fine particles.

6. An image forming apparatus provided with the electrophotographic photoreceptor according to claim 1; charge means for charging the electrophotographic photoreceptor; exposure means for exposing the charged electrophotographic photoreceptor so as to form an electrostatic latent image; developing means for developing the electrostatic latent image with toner to form a toner image; transfer means for transferring the toner image onto a recording material; and fixing means for fixing the transferred toner image on the recording material.

* * * * *